United States Patent [19]

Thomas

[11] 3,942,915

[45] Mar. 9, 1976

[54] FLEXIBLE TUBE PUMP

[75] Inventor: Carlisle Alton Thomas, Kalamazoo, Mich.

[73] Assignee: Dias, Incorporated, Kalamazoo, Mich.

[22] Filed: Aug. 5, 1974

[21] Appl. No.: 494,511

[52] U.S. Cl. ..... 417/360; 417/412; 417/477

[51] Int. Cl.[2] F04B 43/00; F04B 43/12; F04B 45/06

[58] Field of Search ..... 417/475, 476, 477, 360, 417/412, 413, 415

[56] References Cited

UNITED STATES PATENTS

| | | | |
|---|---|---|---|
| 2,899,907 | 8/1959 | Becher | 417/477 |
| 2,909,125 | 10/1959 | Daniels | 417/477 |
| 2,955,543 | 10/1960 | Daniels | 417/477 X |
| 3,046,903 | 7/1962 | Jones | 417/412 X |
| 3,140,666 | 7/1964 | Currie | 417/477 |
| 3,386,382 | 6/1968 | Schuette et al. | 417/477 X |
| 3,402,673 | 9/1968 | Ballentine et al. | 417/477 |
| 3,406,635 | 10/1968 | Tybring | 417/412 X |
| 3,799,703 | 3/1974 | Paine et al. | 417/312 |

*Primary Examiner*—Carlton R. Croyle
*Assistant Examiner*—Robert E. Gluck
*Attorney, Agent, or Firm*—Woodhams, Blanchard and Flynn

[57] ABSTRACT

A flexible tube pump comprises motor means having mounting elements on the casing thereof and a rotatable shaft. A rotor is carried by the shaft and impeller elements are distributed circumferentially on the rotor to orbit as the rotor rotates. A substantially U-shaped shield has leg means securable to the motor casing mounting elements and a semicircular bight portion cantilevered from the leg means substantially concentrically of the orbit of the impeller elements. A compressible tube is engagable between the shield and orbiting impeller elements. A housing may enclose the motor, rotor and shield, the motor being fixed to a cover on the housing and end portions of the tube extending out through a wall of the housing.

13 Claims, 7 Drawing Figures

FLEXIBLE TUBE PUMP

FIELD OF THE INVENTION

This invention relates to a flexible tube pump and more particularly relates to a flexible tube pump in which a compressible, fluid carrying tube is disposed between close spaced fixed and moving compressing elements for causing sequential movement of quantities of fluid along the tube.

BACKGROUND OF THE INVENTION

The present invention was developed in recognition of a long felt need for a peristaltic, or flexible tube, pump combining low cost with accurately metered fluid transfer even at relatively low flow rates and pressures.

Although the preferred embodiment disclosed in detail hereafter was developed in connection with apparatus for metering an antiprecipitate concentrate liquid to the water reservoir of a humidifier, to control accumulation of mineral deposits therein, the present invention is usable with, or adaptable to, other devices for other purposes, including, for example, metering of liquid biocides or bacteriacides to cooling towers, metering of liquid treatment products to swimming pool installations, metering of water or liquid plant food solutions to containerized plants, and so forth.

Although peristaltic type pumps have long been known, none, insofar as I am aware, provide the advantageous combination of features present in the present invention. Particularly, prior peristaltic pumps of which I am aware have been relatively high cost items and of relatively complex construction, often requiring relatively sophisticated manufacturing steps, including substantial machining. Prior peristaltic pumps frequently have been relatively imprecise as fluid metering devices, particularly with relatively small flow rates. Further, such prior pumps have frequently been relatively bulky and space consuming and ill adapted for use in available small spaces, for example, within the housing or cabinet of an existing device, such as a humidifier, and further have often been relatively inflexible as to mounting.

Accordingly, the objects of this invention include provision of:

1. A flexible tube pump of simplified construction having relatively few and simple parts, in which parts associated with the pump mechanism are produceable by molding of known plastic materials without machining, and which is readily manufacturable in high volume at low cost.

2. A pump, as aforesaid, capable of incorporating standard, widely available motive power sources.

3. A pump, as aforesaid, which is compact and usable in small spaces such as in equipment cabinets existing devices to which such pump is to supply fluid and which eliminates the need for separate and additional components to mount the motor and pumping mechanism.

4. A pump, as aforesaid, which is adaptable in installation and can be readily installed by persons without prior training and which makes use of adhesive bonding techniques in mounting.

5. A pump, as aforesaid, which is capable of precise metering at relatively small flow rates and pressures.

Other objects and purposes of this invention will be apparent to persons acquainted with apparatus of this general type upon reading the following specification and inspecting the accompanying drawings.

Figure 1:
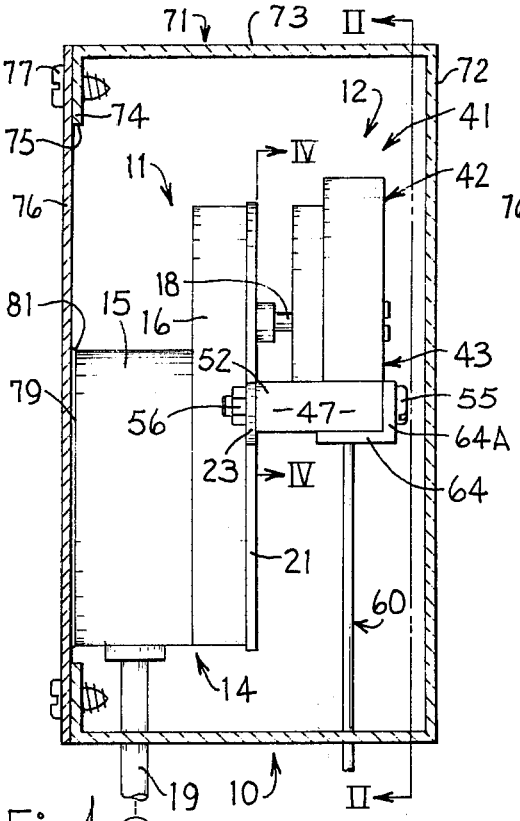
FIG. 1 is a side elevational view of a pump embodying the invention and disclosing, in central section, a housing for containing such pump.

Certain terminology will be used in the following description for convenience in reference only and will not be limiting. The words "up," "down," "right" and "left" will designate directions in the drawings to which reference is made. The words "front" and "rear" will refer to the right and left sides of the apparatus as shown in FIG. 1. The words "in" and "out" will refer to directions toward and away from, respectively, the geometric center of the apparatus and designated parts thereof. Such terminology will include derivatives and words of similar import.

SUMMARY OF THE INVENTION

The objects and purposes of the invention are met by providing a flexible tube pump comprises motor means having mounting elements on the casing thereof and a rotatable shaft. A rotor is carried by the shaft and impeller elements are distributed circumferentially on the rotor to orbit as the rotor rotates. A substantially U-shaped shield has leg means securable to the motor casing mounting elements and a semi-circular bight portion cantilevered from the leg means substantially concentrically of the orbit of the impeller elements. A compressible tube is engageable between the shield and orbiting impeller elements. A housing may enclose the motor, rotor and shield, the motor being fixed to a cover on the housing and end portions of the tube extending out through a wall of the housing.

DETAILED DESCRIPTION

The pump assembly 10 (FIGS. 1 and 2), embodying the invention, comprises a motor unit 11 and a pump unit 12. In the preferred embodiment shown, the motor unit comprises a conventional gear motor having a casing 14. The casing 14 includes a generally cylindrical motor casing portion 15, for enclosing conventional electric motor components, and a gear casing portion 16 which as shown in FIG. 1 extends upwardly beyond the portion 15. The gear portion 16 encloses a conventional reduction gear train positively driven by the motor components in casing portion 15 and further supports by suitable bearings, one of which is indicated at 17 (FIG. 3), a drive shaft 18. The drive shaft 18 extends forwardly, or rightwardly, from the rightward face of the motor unit 11.

An insulated power cable 19 extends from the motor casing portion 15 and contains conductors, not shown, connectable to a suitable voltage supply S. The supply S may be of any conventional nature. For example, the supply S may be a switchable AC supply wherein the motor unit 11 may be a fixed rpm AC synchronous motor. Alternatively, the supply S may be a variable voltage DC supply wherein the motor unit 11 may be a variable speed DC motor. It is contemplated that other variations in motor type and supply type may be utilized.

In the preferred embodiment shown, the front wall 21 of the gear casing portion 16 is a substantially plate-like member having a pair of mounting elements, or ear-like projections, 23 (FIGS. 1 and 2) extending laterally outboard of the gear casing portion 16 and having holes 24 therethrough. Such ears 23 are normally utilized to mount the motor unit 11 in a position of use, but in the present invention provide a different function, as discussed below. The ears 23 are, in the embodiment shown, evenly spaced somewhat below the shaft 18.

Motor unit 11 may, for example, be the type PX 300 manufactured by Autotrol Corporation of Crystal Lake, Illinois.

The pump unit 12 comprises a generally disk like rotor 26 (FIGS. 2 and 3) including a disk 25 and an integral substantially cylindrical boss 27, integral with and extending forwardly from the disk 25. A central opening 28 extends through the rotor 26 for snugly receiving the shaft 18 of the motor unit 11 therein. In the embodiment shown, the shaft 18 is provided with a flat 29 and the central opening 28 is of corresponding cross-section to establish a positive drive connection between the shaft and rotor. The flat 29 defines a step 30 on the shaft 18 which abuts the rear face of the rotor disk 25 to positively axially locate the rotor with respect to the shaft, and here in spaced relation from the casing portion 16. The shaft 18 and rotor 26 are preferably snugly interfitted to prevent axial slippage therebetween. The forward end of the central opening 28, at the forward end of the boss 27, is radially enlarged at 31 to admit a suitable tool, should it be desired to remove the rotor 26 from the shaft 18 without risk of damage to either.

The rotor 26 further includes a plurality, here three, of identical, forwardly extending and integral spindles 33. The spindles 33 are evenly circumferentially spaced on the forward face of the disk 25 and are radially spaced somewhat inboard of the periphery thereof. The spindles 33 preferably are each cylindrical, except for an enlarged head 34 (FIG. 7) at the forward end thereof.

Figure 7:
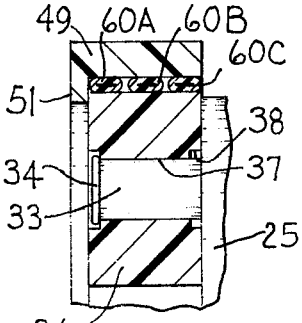
FIG. 7 is an enlarged, fragmentary sectional view substantially taken on the line VII—VII of FIG. 2.

Impeller means here comprise substantially cylindrical, hollow rollers 36 (FIG. 7). Each roller 36 includes a cylindrical central opening 37, here recessed at the ends thereof, as indicated at 38. The rollers substantially correspond in length to the spindles 33 and are of sufficiently resilient material as to permit each roller to be snap fitted over the head 34 of its corresponding spindle 33 to assume the assembled position shown in FIGS. 3 and 7, wherein each roller 36 rotatably bears on the central portion of the spindle 33 thereof in a radially snug but freely rotatable manner. Engagement between the head 34 and the adjacent recess 38 maintains the roller on the spindle in normal use and, with suitable end clearance, maintains the rear face of the roller 36 close adjacent the disk 25. The diameter of the rollers 36 is such as to enable same to slightly overhang the edge of the disk 25.

Due to the relatively light axial loading on the rollers 36 and due to the low friction qualities of the material utilized for the rollers 36 and disk 25, the rollers 36 have been found to rotate freely despite the absence of an intervening thrust bearing between same and the disk 25 and despite the relatively large area of potential rotational contact therebetween.

The pump unit 12 further includes a generally U-shaped shield 41 (FIGS. 2 and 3), having a semicircular bight portion 42 which integrally joins a substantially parallel pair of end portions 43 and 44. The end portions 43 and 44 each include an extension 46 of the bight portion 42 and a terminating portion defining a transversely extending boss 47 for mounting the shield on the motor unit 11 as hereinafter described.

The shield 41 includes a peripheral wall, or band 49, substantially of rectangular cross-section, which extends in a curved, semicircular manner through the bight portion 42 to the extensions 46 and thence to integral connection with the bosses 47. The shield 41 further includes a substantially planar, radially short flange 51, which extends radially inward from the forward edge of the peripheral wall 49.

The rotor 26, rollers 36, and shield 42 are preferably molded from suitable synthetic resin materials, such as nylon and/or delrin, and preferably require no machining. For example, a delrin shield and nylon rotor may be used with rollers of nylon or delrin, delrin-nylon interfaces providing low friction and long wear.

Figure 4:
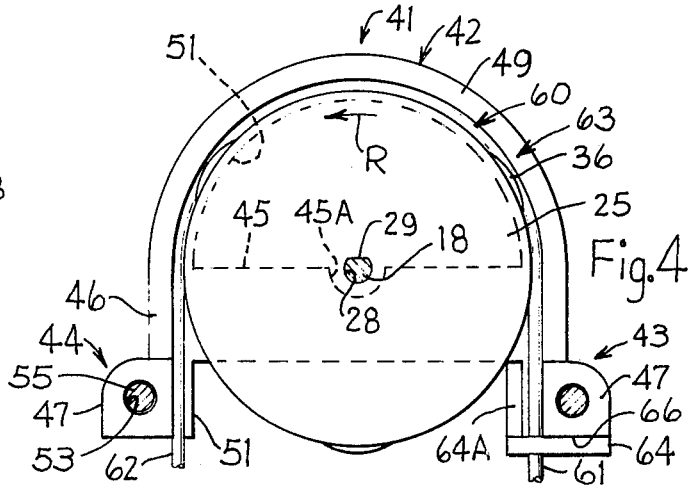
FIG. 4 is an enlarged, fragmentary sectional view substantially taken on the line IV—IV of FIG. 1.

The bosses 47 are substantially cylindrical in shape, and in the preferred embodiment shown, extend rearwardly and outwardly from the peripheral wall 49. Each boss 47 has a rear mounting end 52 (FIG. 1) adapted to seat on the forward face of a corresponding one of the motor unit ears 23. Each of the bosses 47 is provided with an axial opening 53 (FIG. 4) therethrough which is coaxially alignable with the hole 24 in the corresponding ear 23. Suitable fastening means, here screws 55, are insertable through the axial openings 53 and aligned ones of the mounting ear holes 24 and are provided with nuts 56 for fixedly securing the bosses 47 to the mounting ears 23 on the motor unit.

Figure 2:
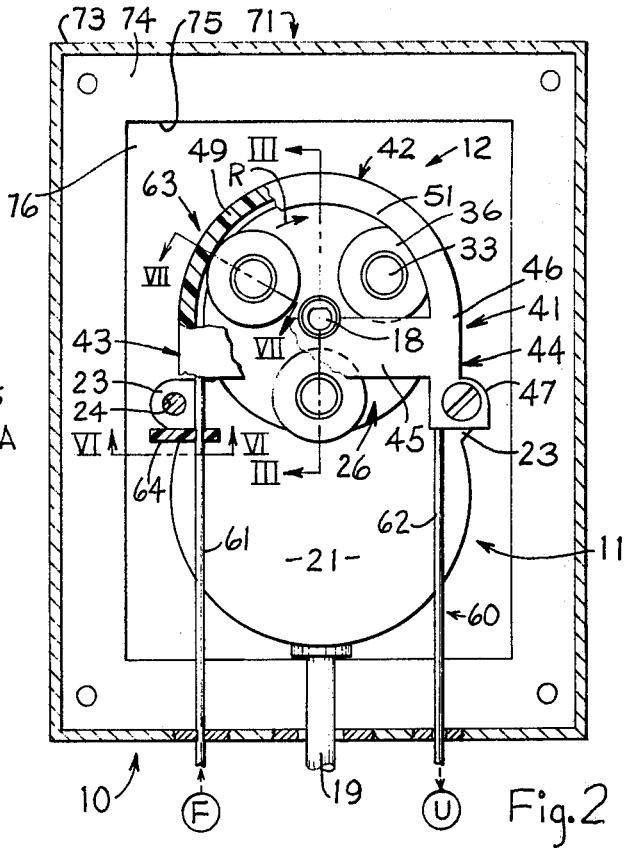
FIG. 2 is a partially broken, sectional view substantially taken on the line II—II of FIG. 1.
Figure 3:
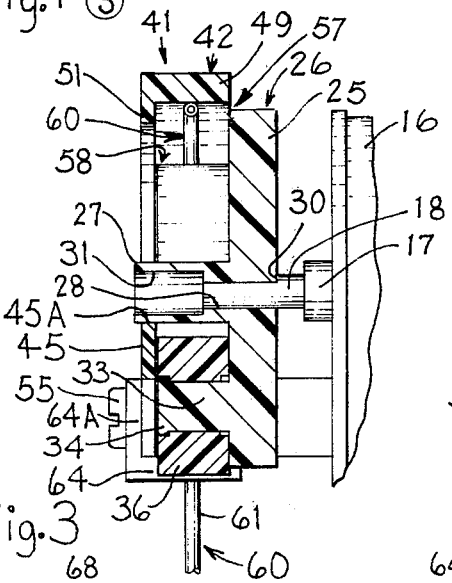
FIG. 3 is an enlarged, fragmentary sectional view substantially taken on the line III—III of FIG. 2.

When so mounted, the bight portion 42 extends forwardly from the rotor disk 25 and is spaced radially outboard therefrom by a clearance 57 (FIG. 3). Correspondingly, the flange 51 radially overlaps the orbit of the rollers 36 (FIG. 2), being spaced forwardly therefrom by a clearance 58 (FIG. 3). Thus, when mounted as shown in the drawings, the bosses 47 position the remainder of the shield substantially in a cantilevered relation, forwardly of the forward wall 21 of the motor unit 11 and so that the peripheral wall 49 partially surrounds and is close spaced from the orbit of the rollers 36.

A flexible, elongate tube 60 extends along the interior face of the shield peripheral wall 49 and has ends 61 and 62 extending along and past the bosses 47. The end 61 is connectible to a source F of fluid to be pumped and the end 62 is connectible to a desired fluid consuming device generally indicated in U in FIG. 2. The tube 60 has a flexible wall and is compressible to close the central passage therethrough where, as at 63 (FIGS. 2 and 4), the tube is contacted by and sandwiched between a roller 36 and the shield peripheral wall 49. The fluid may be a gas or liquid.

Figure 5:
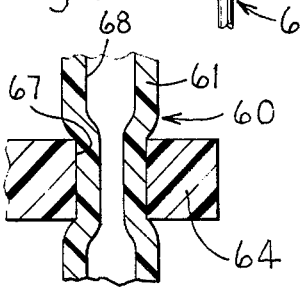
FIG. 5 is an enlarged fragment of the tube retainer portion of FIG. 2, showing the tube in central section.
Figure 6:
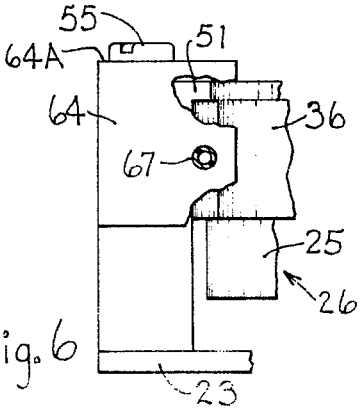
FIG. 6 is an enlarged, fragmentary and partially broken sectional view taken on the line VI—VI of FIG. 2.

In the preferred embodiment shown, a plate-like retainer element 64 (FIGS. 1, 2 and 4) is fixed at the lower face 66 (FIG. 4) of the one of the bosses 47 past which the supply end 61 of the tube 60 extends from the source F. The rotor 26, as seen from the front, in FIG. 2, is here arranged for clockwise rotation as indicated by the arrow R. The orbiting rollers 36, due to their compressive contact with the tube 60, tend to pull such tube in a clockwise direction therewith. Thus, in operation, the tube tends to creep along the surface of the shield and away from the fluid source F. To counteract this, the tube inlet end 61 (FIG. 5) is led through an undersized hole 67 in the retainer element 64. The hole 67 is sized to allow the tube 60 to be inserted thereinto and forceably pulled axially therethrough, but to sufficient frictionally engage the outside of the tube 60 as to prevent unintended axial movement of the tube by the orbiting rollers 36. It is contemplated that the retainer element 64 may be secured to the adjacent boss 47 by a suitable adhesive, thus enabling by a 180° rotation during assembly, use of the same retainer element 64 on either of the bosses, enabling a given shield to be arranged for either clockwise or counterclockwise rotation of the rotor. Alternatively, the retainer element 64 can be integral with the shield. Preferably, a perforate flange 64a at the forward end of the retainer element is securable by screw 55 to the forward face of the corresponding boss 47. Normally, the undersize nature of the hole 67 does not materially constrict passage 68 within the tube, the amount of constriction shown in FIG. 5 being somewhat exaggerated for clarity of illustration.

The shield preferably includes a laterally extending and plate-like bearing member 45 extending between and preferably integrally molded with opposed portions of the inwardly extending shield flange 51. Here, the upper edge of the bearing plate 45 is preferably being about level with the center of the motor shaft and includes a centered semi-circular notch 45A receiving the rotor boss 27 in rotative bearing relation. The plate-like bearing member 45 enables use of a motor unit 11 with relatively low capacity bearings, substantially prolonging the life thereof, by supporting the outboard end of the motor shaft and rotor boss assembly. In addition, the bearing plate 45 acts as a safety guard tending to prevent inadvertent insertion during operation of a person's fingers into the bight between the rollers and shield sidewall, while yet leaving open the bight 42 of the shield 41 for observation and to facilitate initial installation of tube 60.

It is contemplated, as shown in FIG. 7, that more than one tube can be utilized. In FIG. 7, for example, three such tubes 60A, 60B and 60C are provided in side-by-side relation between roller 36 and peripheral wall 49. In such instance, the retainer element 64 would be suitable provided with a corresponding number of undersize holes 67, one for each such tube. The arrangement of FIG. 7 may be particularly advantageous where it is desired to increase flow capacity without altering the components of the pump assembly 10, or for enabling one pump assembly to provide different flow levels at different times without altering tubing size or rotor speed. Further, the multitube arrangement of FIG. 7 advantageously allows the same pump to meter, simultaneously, several different fluids without intermixing same and/or to provide fluids from one or several sources to one or more points of use.

In the particular embodiment shown, a substantially rectangular housing 71 (FIGS. 1 and 2), here of sheet metal, such as sheet aluminum, is provided. The housing includes a front wall 72 and plural side walls 73. The side walls preferably have flanges 74 defining a rear opening 75. A cover 76 is releasably secured to the flanges 74, here by screws 77, to close the rear opening 75.

In the preferred embodiment of the invention shown, the motor casing portion 15 is provided with a relatively flat rear wall 79. The rear wall 79 is secured to the inside face of the cover 76 by adhesive bonding, for example by an epoxy resin bond, indicated at 81. Thus, the entirety of the motor unit 11 and pump unit 12 is conveniently supported upon the cover 76 by the adhesive bond 81.

In the embodiment shown, the end portions of the tube 60 and the end portion of the electrical cable 19 are led through openings in the lower side wall 73 of housing 71 through suitable openings which, if desired, may be provided with grommets or the like, not shown. While it is contemplated that tube creep can also be prevented by passing the tube out through an undersized hole in the housing wall, the retainer 64 is preferred.

It is contemplated that, in some uses, the housing 71 may be eliminated and the cover 76 or a similar member, may be used for mounting of the pump assembly 10. It is further contemplated that in still other uses it may be desired to mount the motor unit 15 directly on an existing wall surface, for example an interior wall of a humidifier housing or the like constituting the utilization device U. In either instance, adhesive bonding of the relatively flat back wall 79 of the motor unit 15 to a mounting surface provides a quick and convenient way to carry out mounting of the combined motor unit and pump unit.

The motor-pump assembly 11, 12 can be mounted in a variety of ways, in addition to that disclosed. For example, it is contemplated that the motor unit 11 can be mounted inside the housing 71 by suitable means such as screws (either the existing screws 55 securing the U-shaped shield 41 to the motor or additional screws as desired) and with the motor shaft 18 extending outwardly through a wall of the housing for exterior support of the rotor 26, the U-shaped shield 41 being secured to the outer face of the housing by the screws 55. Alternatively, it is contemplated that suitable bracketing can be employed to secure the motor 11 to the housing 71, and therewith the pump assembly 12 locating both within the housing 71.

OPERATION

Although the operation of the apparatus described above will be understood from the foregoing description by skilled persons, a summary is given below for convenience.

The apparatus 10 is preferably assembled by snapping the rollers 36 onto the spindles 33, whereafter the completed rotor 26 is pressed onto the motor unit shaft 18, until it contacts the step 30, thus positively axially locating same with respect to the shaft. The flat 29 on the shaft, cooperating with the corresponding flat in the central opening 28 of the rotor, prevents relative rotation between the rotor and shaft. The rotor is held on the shaft 18 by the friction of its press fit thereon.

The shield 41 is positioned on the gear casing portion of the motor unit as shown in FIGS. 1 and 2, with the rear ends of the bosses 47 on the ears 23. The bosses 47 are secured on the ears 23 by insertion of the screws 55 through the holes 53 and 24 and installation of the nuts 56. Such fixedly secures the shield to the motor unit 11.

The tube 60 may then be led into its operative position shown between the orbit of the rollers 36 and the peripheral wall 49. Such may be assisted by rotation of the rotor, the leading end of the tube closely following one of the rollers through its orbit and being sequentially engaged by the others of said rollers until the leading end 62 emerges from the downstream side of the shield. Thereafter, the remaining end 61 of the tube may be inserted through the inner end of the hole 67 in the retainer 64 and forceably pulled downwardly therethrough. With the above assembly completed, the apparatus is ready for installation. Installation is preferably accomplished by securing the rearward face 79 of the motor unit to a suitable supporting surface, for example the plate-like cover 76 of FIG. 1, by the adhesive bond 81.

Where the motor unit 11 and pump unit 12 are to be enclosed in the housing 73, the ends 61 and 62 of the tube 60 are led through suitable openings provided in a wall of the housing 73 and the electric power cable 19 is similarly led through a suitable opening in the housing wall. Thereafter, the pump unit and motor unit are inserted into the housing 73 through the opening 75 and the cover 76 is secured to the housing flanges 74 by the screws 77. Installation is completed by connection of the power cable 19 to the power source S in any convenient and conventional way and by connection of the tube ends 61 and 62 to the source F, of liquid for example, and to the device U to be supplied.

When liquid from the source F is to be pumped, the motor unit 11 is energized through the power cable 19, rotating the shaft 18, and therewith the rotor 26. The rollers orbit with the rotating rotor 26, for example in the clockwise direction shown by the arrow R, so that the rollers 36 sequentially contact the intermediate portion of the tube 60 backed by the peripheral wall 49 in the bight portion 42. The spacing between the opposed shield peripheral wall and rollers pinch closed the tube portion therebetween, as indicated for example in FIG. 7. This pinched or flattened part of the tube travels longitudinally of the tube as the corresponding roller orbits along the curved bight portion peripheral wall 49, driving a slug of liquid in the tube ahead thereof and drawing liquid into the portion of the tube therebehind. Where, as in the embodiment shown, three rollers are provided on the rotor 26, at least one of these rollers, and much of the time two thereof, will contact the tube at any given time. Thus continuous sequence of liquid slugs will be positively displaced along the tube from source F to device U as rotor rotation continues. Gripping of the supply end 61 of the tube by the retainer 64 prevents the tube from creeping along the peripheral wall 49 of the shield due to such rotation of the rotor 26.

The amount of liquid pumped per unit time will depend on several factors. These include the internal diameter of the tube 60 and the average speed of rotation of the rotor 26. The rotor 26 may be either continuously or periodically rotated. Further, operation of the rotor, and more particularly energization of the motor unit 15, may be accomplished manually as by suitable manual electrical switching, not shown, at the power source S. Alternatively, the motor unit 15 may be automatically operated by suitable automatic switching, not shown, responsive for example to flow of another liquid, to be treated with the liquid supplied by the assembly 10, through the utilization device U. In either mode, the assembly 10 is capable of metering precise amounts of liquid from the source F to the utilization device U, even when the average flow rate through the assembly 10 is relatively small.

In the particular embodiment shown, shaft 18 rotational speeds in the range of one revolution per day to 30 rpm are contemplated.

Further, tubing sizes in the range 0.005 inch I.D. to 0.25 inch O.D. are contemplated. As stated, the tube 60 is of relatively flexible material, preferably of viton. However, alternative materials such as polyvinyl chloride, urethane, silicone and rubber are contemplated. With larger diameter tubes, a relatively thinner tube wall section and/or a more flexible tubing material is desirable to reduce motor power requirements.

Considering typical rotation speed and tubing size values, a tube 60 with a 0.137 inch O.D. and 0.105 inch I.D. (a 0.016 inch wall thickness), a shaft 18 rotation rate of one rpm and a peripheral wall 49 internal radius of 0.832 inch provides a flow rate through the tube 60 of about 45 m.l./hour. Flow rates up to about 4000 m.l./hour are contemplated, being obtainable within the above tubing size and rpm ranges.

While of simplified one piece construction and while supported on the motor unit at only two points, it has been found that the shield 42 is, when installed on the motor unit as shown, very stable and rigid, providing an unmoving backing for the tube 60 when the latter is engaged and compressed by an orbiting roller 36. Although the flange 51 positively prevents displacement of the tube forwardly out of the shield area, it is believed that such flange also promotes rigidity of the shield.

Although the close spacing of the shield peripheral wall 49 from the rotor disk 25 and of the flange 51 from the orbit of the rollers 36 positively prevents the tube 60 from displacing forwardly or rearwardly out of its location within the confines of the shield, it has been found that the tube 60 tends to remain in a substantially fixed forward, rearward location on the peripheral wall 49 during operation and that this location is substantially in alignment with the opening 67 in the retainer 64, which is located relatively close to the point of initial engagement of the two by the orbiting rollers 36.

In testing of the apparatus disclosed herein, liquid output pressures in the range of about 10 p.s.i. have been obtained.

Should it be desired to vary the flow rate through the pump assembly, such may readily be accomplished by increasing or decreasing the number of tubes utilized as aforementioned. Alternatively, the rotation rate of the motor unit can be increased or decreased by control of the power input thereto from source S or by selection of a different motor-gear train combination. As a further alternative, a tube 60 of larger or smaller size can be substituted. Should the newly substituted tube differ materially in wall thickness from the previously used tube, this difference in wall thickness may be compensated by snapping off the existing rollers 36 from the spindles 33 and substituting rollers of smaller or larger outside diameter so as to maintain a roller to shield the peripheral wall dimension, taken for example with a given roller opposite the top of the shield in FIG. 2, of about twice the tubing wall thickness.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A flexible tube pump, comprising in combination:
motor means having mounting means and a rotatable shaft;
a rotor carried by said shaft for rotation therewith and located adjacent said motor means;
impeller means distributed circumferentially on said rotor and responsive to rotation of said rotor for orbiting therewith;
a substantially U-shaped shield having leg means securable on said motor means through said mounting means and a semi-circular bight portion cantilevered from said leg means in substantially concentric relation with the orbit of said impeller means;
a compressible tube for carrying a fluid, said tube being engageable between said shield and said impeller means and having end portions extending along said leg means, said shield having a U-shaped peripheral wall substantially parallel to said shaft and opposed to said impeller means, the edge of said peripheral wall remote from said motor means being flanged inwardly to overlie said tube, and including a plate-like bearing member extending between said leg means substantially as a continuation of said flange and having a bearing surface engageable with a central portion of said rotor and backing same against the restoring force of the compressed tube;
whereby rotation of said rotor by said shaft causes said impeller means to move said fluid through said tube.

2. The apparatus of claim 1 in which said motor means includes a casing having a front face spaced rearwardly from said shield and mounting ears at opposite sides of the casing front face and laterally offset from said shaft, said leg means of said shield comprising a pair of laterally opposed legs extending from opposite ends of said semicircular bight portion, said shield including a pair of parallel columnar bosses extending rearwardly from free ends of the corresponding pair of legs toward respective ones of said pair of motor casing ears, means fixing the rear end of said columnar bosses with respect to said ears, said shield being solely supported by said pair of columnar bosses and being cantilevered laterally therefrom toward and beyond said motor shaft.

3. The apparatus of claim 1 in which the U-shaped shield is entirely open to the rear laterally of said peripheral wall, unintended egress of the tube from the semicircular bight portion of the shield being blocked by spacing of the rotor peripheral portion and shield rear peripheral wall edge at less than the tube diameter.

4. A flexible tube pump, comprising in combination:
an electric motor unit including an elongate casing housing an electric motor at one end, a laterally offset drive shaft and bearings therefor at the other casing end and an intervening reduction drive train for rotatably driving said shaft from said motor, said shaft extending forwardly through a front wall of the casing, the casing further having a pair of laterally opposed mounting portions laterally spaced across an intermediate portion of said casing front wall, said mounting portions and shaft being located at the apices of a triangular zone of said front wall;
a rotor on said shaft;
impeller means distributed circumferentially on the front of said rotor and responsive to rotation of the rotor for orbiting therewith;
a shield having a two-point support formed by a pair of column-like bosses releasably fixed to said casing mounting portions and extending forwardly therefrom, said shield further having a U-shaped band solely supported by lateral cantilevering from said pair of bosses in forwardly spaced relation to said casing front wall, said U-shaped band having a semicircular bight portion and a pair of side-by-side leg portions each of said leg portions having a first end and a second end, said first ends of said leg portions being joined to each other by said bight portion, forward ends of said column-like bosses being connected to said second ends of said leg portions, said impeller means facing the inner surface of said band, said semicircular band portion being concentric with said shaft and the orbit of said impeller means;
a compressible tube for carrying a fluid and laterally squeezable between said shield band and said impeller means and having end portions extending along said leg portions;
whereby rotation of said rotor by said shaft causes said impeller means to move said fluid through said tube.

5. The apparatus of claim 4 in which said casing mounting portions are ears extending laterally from the casing and the pair of mounting bosses each have an axial passage therethrough and including a screw extending through each said passage and the corresponding ear and securing the rear end of each boss directly to its corresponding casing ear, the U-shaped band opening laterally away from said impeller means between the forward ends of said bosses.

6. The apparatus of claim 4 including a laterally extending support surface spaced rearwardly from the shield by the motor casing and to which the rear face of the motor casing is directly secured, the motor casing extending forward from said support surface and the U-shaped shield being laterally offset from said secured rear face of the motor casing.

7. The apparatus of claim 4 including a box-like housing commonly enclosing therein the motor, rotor and shield, the box-like housing having an open rear face closed by a removable cover plate, the rear face of the motor casing being secured to the front face of said cover by an intervening adhesive bond, whereby removal of said cover from said box-like housing also removes and exposes said motor, rotor and shield..

8. The apparatus of claim 7 in which said box-like housing includes a wall toward which said U-shaped shield opens, said last mentioned wall having openings through which said end portions of said tube extend out of the box-like housing.

9. The apparatus of claim 4 in which the rear face of said shield is free of radially inwardly extending flanges, the rear edge of said band being radially adjacent the front edge of said rotor at a distance less than the outside diameter of said tube, the shield including a flange extending radially inwardly from the front edge of said band in close overlying relation with the orbit of said impeller means, whereby both rearward and forward shifting of the tube out of sandwiched relation between the impeller means and band is prevented, the width of the band between its rear edge and said flange being substantially the axial dimension of said impeller means.

10. A flexible tube pump, comprising in combination:

a motor unit having a casing and a rotatable shaft extending forwardly therefrom;

a unitary molded plastic rotor comprising a disk fixed on and rotatably carried by said shaft forward of said casing, and a plurality of integral circumferentially distributed spindles extending forward from said disk and terminating in radially enlarged integral heads;

a molded plastic roller rotatably carried by each spindle and snap fitted over the head thereof, said rollers extending radially beyond said disk and orbiting therewith;

a unitary molded plastic shield substantially of horseshoe shape comprising a U-shaped semicircular band with laterally spaced ends and integral column-like mounting members extending rearwardly from the band ends toward and releasably securable at spaced points of the motor casing, the shield having an open back for receiving said rollers forwardly thereinto in centered, axially coextensive relation with a semicircular intermediate portion of said U-shaped band, the front face of said rotor disk substantially closing said open back of said shield, the front of said shield being open except for a substantially D-shaped flanged structure integral with the front edge of said band and including a radially inwardly extending flange partially overlapping the rollers and a cross member connecting end portions of the U-shaped band adjacent the shaft and mounting members;

a compressible tube for carrying a fluid and engageable between the shield band and rollers and having ends extending laterally beyond said column-like mounting members;

means fixed on and extending laterally inboard from the upstream one of said column-like mounting members for releasably fixing said tube thereto.

11. The apparatus of claim 10 in which the rotor is of radius less than and closely approaching the interior radius of the semicircular band portion and the rotor front face is substantially coplanar with the rear edge of said shield band, the radial rotor-to-band spacing being less than the tube diameter thereby blocking unintended displacement of the tube rearwardly out of said shield.

12. The apparatus of claim 10 in which the rotor includes a central boss extending forwardly from the front face of the rotor disk at least to the front of said shield, said shield cross member having a notch opening toward the semicircular portion of said band and rotatably engaged by said rotor central boss to resist bending of said motor shaft laterally toward the open end of said U-shaped shield during pumping operation.

13. The apparatus of claim 10 in which said means releasably fixing the tube to the upstream mounting member is a plate fixed at the upstream face of said one column-like mounting member and extended laterally toward the other column-like mounting member, said plate having an opening therethrough in alignment with said tube and of diameter less than the outside diameter of the tube for receiving said tube axially therethrough during assembly and snugly frictionally holding said tube therein against axial tube displacement during pumping operation.

* * * * *